US006363645B1

(12) United States Patent
Hunter

(10) Patent No.: US 6,363,645 B1
(45) Date of Patent: Apr. 2, 2002

(54) INSERT FOR DISPLAY PANELS

(76) Inventor: Bruce A Hunter, 27149 Ridgewood Dr., Wind Lake, WI (US) 53185

( * ) Notice: Subject to any disclaimer, the term of this patent is extended or adjusted under 35 U.S.C. 154(b) by 17 days.

(21) Appl. No.: 09/030,385

(22) Filed: Feb. 25, 1998

(51) Int. Cl.[7] ..... A47F 5/00
(52) U.S. Cl. ..... 40/618; 211/87.01
(58) Field of Search ..... 40/618, 611; 52/36.4, 52/36.5; 211/87.01

(56) References Cited

U.S. PATENT DOCUMENTS 4,450,970 A 5/1984 Shepherd
4,615,448 A 10/1986 Johnstonbaugh
4,944,416 A 7/1990 Petersen et al.
5,018,323 A 5/1991 Clausen
5,138,803 A 8/1992 Grossen

*Primary Examiner*—Cassandra H. Davis
(74) *Attorney, Agent, or Firm*—Ryan Kromholz & Manion, S.C.

(57) ABSTRACT

An insert is adapted to be inserted in an undercut T-shaped slot extending horizontally along an exposed surface of a panel, the undercut extending parallel to the surface and including an opening extending between the undercut and the surface. The insert is formed of resilient material having a foot adapted to be extended into the undercut and a pair of opposed legs which extend through the opening when the insert is positioned in the T-shaped slot, the legs providing between them an opening communicating with the foot. The legs have flanges on their outwardly extending ends which flanges face away from each other and are spaced outwardly away from the surface of the panel on opposite sides of the slot when the insert is positioned in the slot.

5 Claims, 2 Drawing Sheets

INSERT FOR DISPLAY PANELS

BACKGROUND OF THE INVENTION

This invention relates to slotted display panels and particularly to improved inserts for slots in such panels which enable providing of decorative effects to the display panels. More particularly, the inserts of this invention support various decorative materials such as sheets of paperboard, plastic or the like which can be surfaced with decorative or informative images.

Various inserts for slotted display panels have been proposed. Often such panels are provided with T-shaped slots into which inserts can be placed. The panels are frequently used for displays in various sales establishments, for example, in shops or malls. Examples of such display panels heretofore in use are U.S. Pat. Nos. 4,615,448, 4,944,416, 5,018,323 and 5,138,803. While these patents show various inserts and or brackets for use with slotted display walls there, nonetheless, remains a need for improved materials useable in conjunction with such walls which would enable the attachment thereto of sheets of patterned or colored material, photographs and the like.

SUMMARY OF THE INVENTION

It is a primary object of the present invention to provide inserts for display panels which are readily formed by extrusion and which can be placed into and removed from undercut T-shaped slots in the panels.

In accordance with an important aspect of the invention such inserts are provided with projecting lips or flanges which extend outwardly from the surface of a panel, thereby providing a means for retaining sheets of material over the surface of the panel substrate. Further, in connection with this aspect, two adjacent inserts are provided with lips or flanges facing toward each other to provide an area therebetween for supporting sheets of material.

A further aspect of the invention relates to possibility that the extrusions can be molded with or coated in various colors which complement the appearance of the substrate panel.

In connection with a further aspect of the invention, the retaining flanges, extending outwardly from the surface of the substrate, are L-shaped, thus leaving a space between the substrate surface and the inner edge of the retaining flanges. This space is utilized by insertion therebetween of various rigid materials such as high pressure laminates, plastic sheets, such as acrylic sheets, cardboard and other card stocks or photographs. The channel between two adjacent flanges will thus hold in place a variety of thin rigid materials.

In connection with a further aspect of the invention the appearance of used or damaged substrates with marred surfaces can be concealed by adding extrusions of the invention and then covering the original substrates with sheets of new decorative materials. In connection with this aspect, a low cost economical method of remodeling existing stores and improving the interior design thereof is provided. Flexibility is also provided which allows frequent changing of colors and appearances, if desired. Also, by inserting large photographs in sections, it is possible to create a large photographic mural on a store wall as a backdrop for products displayed using standard slat wall accessories such as hooks, etc. In connection with this aspect the photographic murals can be changed easily and cost effectively when it is desired to introduce different or new products and conduct various sales events. Similarly, product information, pricing, sales announcements and various other materials can be mounted on cardstock or plastic sheets and inserted into the channels formed between flanges of adjoining extrusions.

Briefly, in accordance with the invention, an insert is adapted to be inserted in an undercut T-shaped slot extending horizontally along an exposed surface of a panel, the undercut extending parallel to the surface and including an opening extending between the undercut and the surface. The insert is formed of resilient material having a foot adapted to be extended into the undercut and a pair of opposed legs which extend through the opening when the insert is positioned in the T-shaped slot, the legs providing between them an opening communicating with the foot. The legs have flanges on their outwardly extending ends which flanges face away from each other and are spaced outwardly away from the surface of the panel on opposite sides of the slot when the insert is positioned in the slot.

Further objects and advantages of the invention will be apparent from the following detailed description, the claims, and the accompanying drawings.

DETAILED DESCRIPTION OF THE INVENTION

Figure 1:
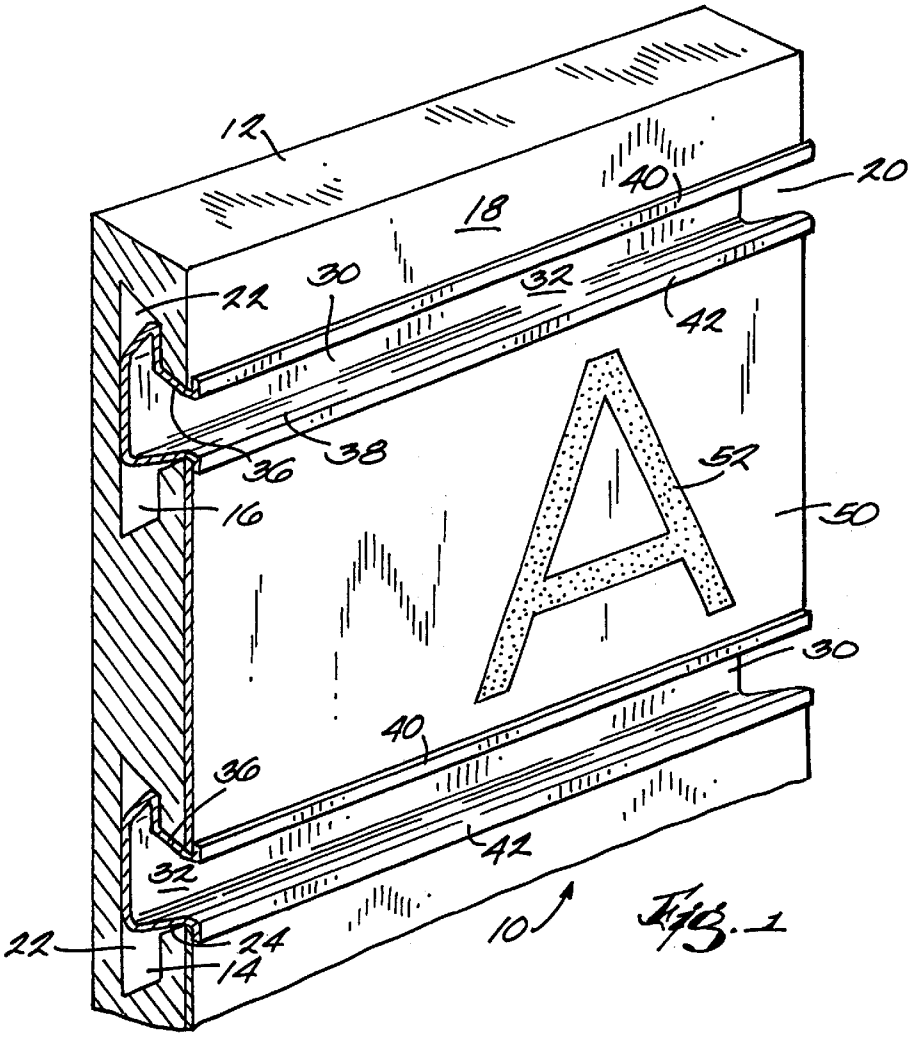
FIG. 1 is a fragmentary perspective view of a slotted display panel which inserts of this invention inserted in the slots and shown supporting sheet of decorative material.

Referring more specifically to the drawings there is seen in FIG. 1 a display panel assembly 10 including a slotted panel 12. Panel 12 may be formed of plywood or other composite material such as chip board, fiber board, resin-impregnated fiber glass, molded plastic or the like. Panel 12 is provided, in accordance with customary practice, with T-shaped slots 14 and 16. Panel 12 includes an exposed surface 18 customarily used for displays. Surface 18 may be painted, varnished or coated with other decorative material such as laminates, as desired.

Slots 14 and 16 are customarily machined or molded during the process of manufacturing panel 12. The slots 14, 16 are generally spaced along the height of the panel 12 and are oriented horizontally. Slots 14 and 16 are formed with horizontal openings 20 which expose a planar rear surface 22. In accordance with customary practice, the open slot areas 20 are surfaced with outwardly converging sloped edges 23 and 24. Undercut areas 26 and 28 at opposite ends of the slots provide the slots with a T-shaped configuration.

In accordance with the present invention the display panel 12 is provided with a plurality of extruded inserts 30. Inserts 30 can be extruded from any rigid material such as aluminum, or, more preferably an extrudable plastic material such as a polyolefin, polyacrylate, polyvinylchloride, etc. Extrusion 30 is formed in a generally L-shaped configuration dimensioned to fit within slots 14 and 16. Due to its size and shape, such an extrusion can be inserted into or removed from a slot through its opening 20. Also, the extrusion can be inserted through either end of the slot, as desired.

The extrusions 30 are, thus, formed with a base portion 32 adapted to engage the interior of the bottom 22 of the slots

Figure 3:
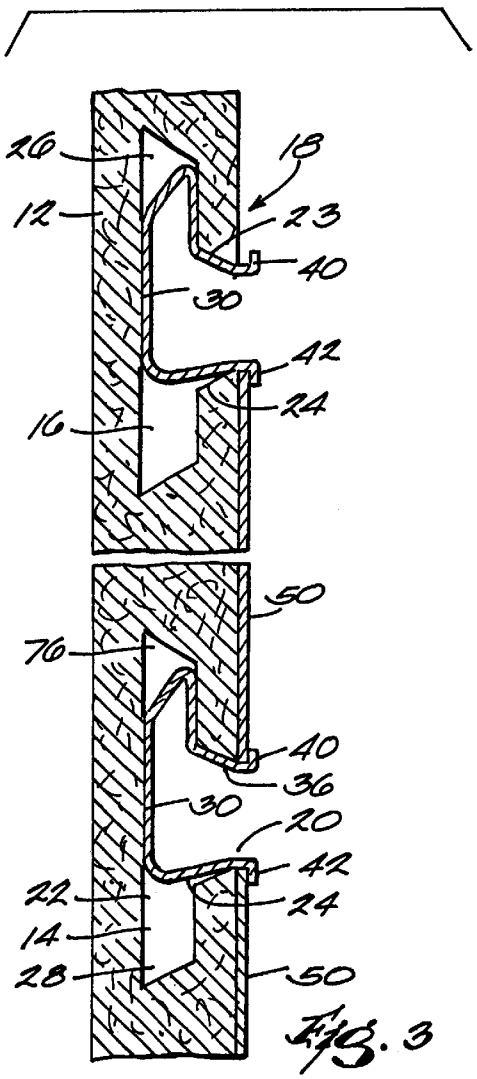
FIG. 3 is an end view similar to FIG. 2 with decorative sheet material supported by the inserts.
Figure 2:
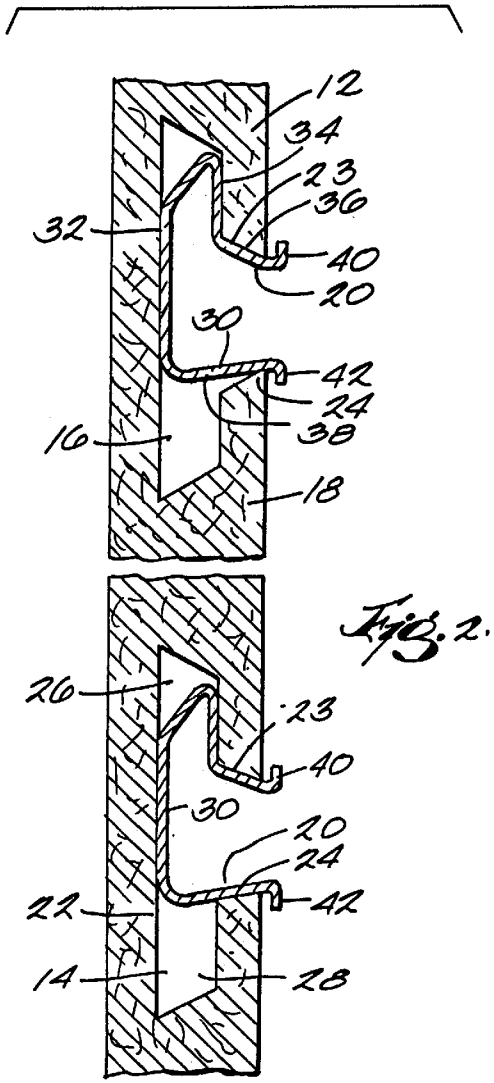
FIG. 2 is a fragmentary cross-sectional view of the slotted display panel of FIG. 1 with inserts installed in the slots thereof.

14, 16 as seen in FIGS. 2 and 3. A toe portion 34 is adapted to engage the interior of the undercut portion 26. The throat segments 36 and 38 of the extrusion 30 are formed so that they fit snugly within the opening 20 of the slots. The portion 36 is preferably sloped so that it engages the slope of the upper converging portion 23 of the slot opening 20. The leg segments 36 and 38 are of a length such that the outer ends thereof, which are formed in the shape of L-shaped flanges 40 and 42, extend outwardly beyond the panel surface 18 as best seen in FIG. 2. It is preferred that the flanges extend approximately 0.04 to 0.05 inch outwardly beyond the surface of the panel. For panels having commonly used of standard slot dimensions with a depth of about 0.5 inch, it is preferred that the distance between the exterior of bottom surface 32 and the outer edges of flanges 40 and 42 be 0.625 inch. This leaves a preferred distance of 0.0465 inch between panel surface 18 and the inner edges of flanges 40 and 42. This enables supporting between the flanges of sheet material having a thickness of about 0.03 to 0.07 inch. It will be apparent to those skilled in the art that these distances may be modified to accommodate display materials having different thicknesses, if desired.

The channels thus formed between adjoining L-shaped flanges 40 and 42 are thus adapted to support a sheet of material 50 over the surface 18. Sheet 50 can be provided with any decorative effect 52 which may be lettering or text, as shown, or photographs, colored designs or graphics, etc. Such sheet material 50 is cut to a height such that it will fit between and be supported by adjoining flanges 40 and 42 as best seen in FIGS. 1 and 3. Examples of sheet materials 50 are paperboard, acrylic sheets, photographs, high pressure laminates, and the like. The sheet materials 50 are readily inserted or removed by flexing sufficiently to permit insertion or removal.

The invention, thus affords great versatility to retail display areas. Product information, pricing, sale announcements and reordering forms can be retained over the slotted wall along with photographs and decorative materials as mentioned above.

Although the foregoing description contains considerable specificity, this should not be construed as limiting the scope of the invention, but as merely providing illustrations of the preferred embodiments of this invention. Thus, the scope of the invention should be determined by the appended claims and their legal equivalents, rather than by the specific examples given.

What is claimed is:

1. An insert adapted to be inserted in a T-shaped slot extending along an exposed surface of a panel, said slot being undercut into said panel and having a T-shaped configuration, said undercut extending parallel to said surface and including an opening extending between said undercut and said surface, said insert being formed of resilient material having a foot adapted to be extended into said undercut and a pair of opposed legs each having an end extending outwardly through said opening when said insert is positioned in said T-shaped slot, said legs providing between them an opening communicating with said foot, said legs having flanges on the outwardly extending ends thereof, said flanges facing away from each other and spaced outwardly, away from the surface of said panel on opposite sides of said slot when said insert is positioned in said slot a distance adapted to removably support, between a pair of adjacent flanges which face each other, a sheet of display material between said exposed surface of said panel and said flanges.

2. An insert according to claim 1 comprising an extruded flexible plastic material.

3. An insert according to claim 1 wherein said opening is provided with outwardly converging edges and said legs are configured to be complementary to said converging edges.

4. A panel assembly comprising a panel having a plurality of horizontal T-shaped slots as defined in claim 1, a plurality of said slots being provided with inserts as set forth in claim 1.

5. An insert according to claim 1 wherein the distance between the bottom of said foot and the outer extremity of said flanges is about 0.625 inch, whereby a display material having a flat configuration can be supported between a pair of adjacent flanges which face each other.

* * * * *